US006089354A

United States Patent [19]

Hettegger

[11] Patent Number: 6,089,354

[45] Date of Patent: Jul. 18, 2000

[54] FORKLIFT

[75] Inventor: Franz Hettegger, Henndorf, Austria

[73] Assignee: Palfinger Crayler Staplertechnik GmbH, Bergheim, Austria

[21] Appl. No.: 08/992,898

[22] Filed: Dec. 18, 1997

[30] Foreign Application Priority Data

Jun. 16, 1997 [AT] Austria ..... 361/97 U

[51] Int. Cl.[7] ..... B66B 9/16; B66F 9/20

[52] U.S. Cl. ..... 187/243; 187/243; 187/244

[58] Field of Search ..... 187/243, 244, 187/238

[56] References Cited

U.S. PATENT DOCUMENTS

| | | | |
|---|---|---|---|
| 1,260,145 | 3/1918 | Cochran | 187/244 X |
| 3,143,190 | 8/1964 | Knights et al. | 187/238 X |
| 4,460,064 | 7/1984 | Lutz et al. . | |

FOREIGN PATENT DOCUMENTS

| | | | |
|---|---|---|---|
| 1 254 861 | 5/1989 | Canada | B66F 11/00 |
| 0250 018 A1 | 5/1987 | European Pat. Off. . | |
| 10 65 328 | 2/1957 | Germany . | |
| 1 208 013 | 8/1984 | U.S.S.R. | B66F 9/12 |
| 1427194 | 11/1973 | United Kingdom . | |
| 2 281 279 | 3/1995 | United Kingdom | B66F 9/075 |

*Primary Examiner*—William E. Terrell
*Assistant Examiner*—Gene O. Crawford
*Attorney, Agent, or Firm*—Lorusso & Loud

[57] ABSTRACT

A forklift with four wheels mounted on a chassis and a gantry which carries the forks and can be folded down longitudinally for transporting the forklift. The chassis of the forklift consists of two parts joined together by a hinge. The two chassis parts pivot relative to each other about a horizontal transverse axis and about a vertical axis, allowing for concurrent movement in the perpendicular axes of the chassis.

6 Claims, 3 Drawing Sheets

FORKLIFT

Figure 1:
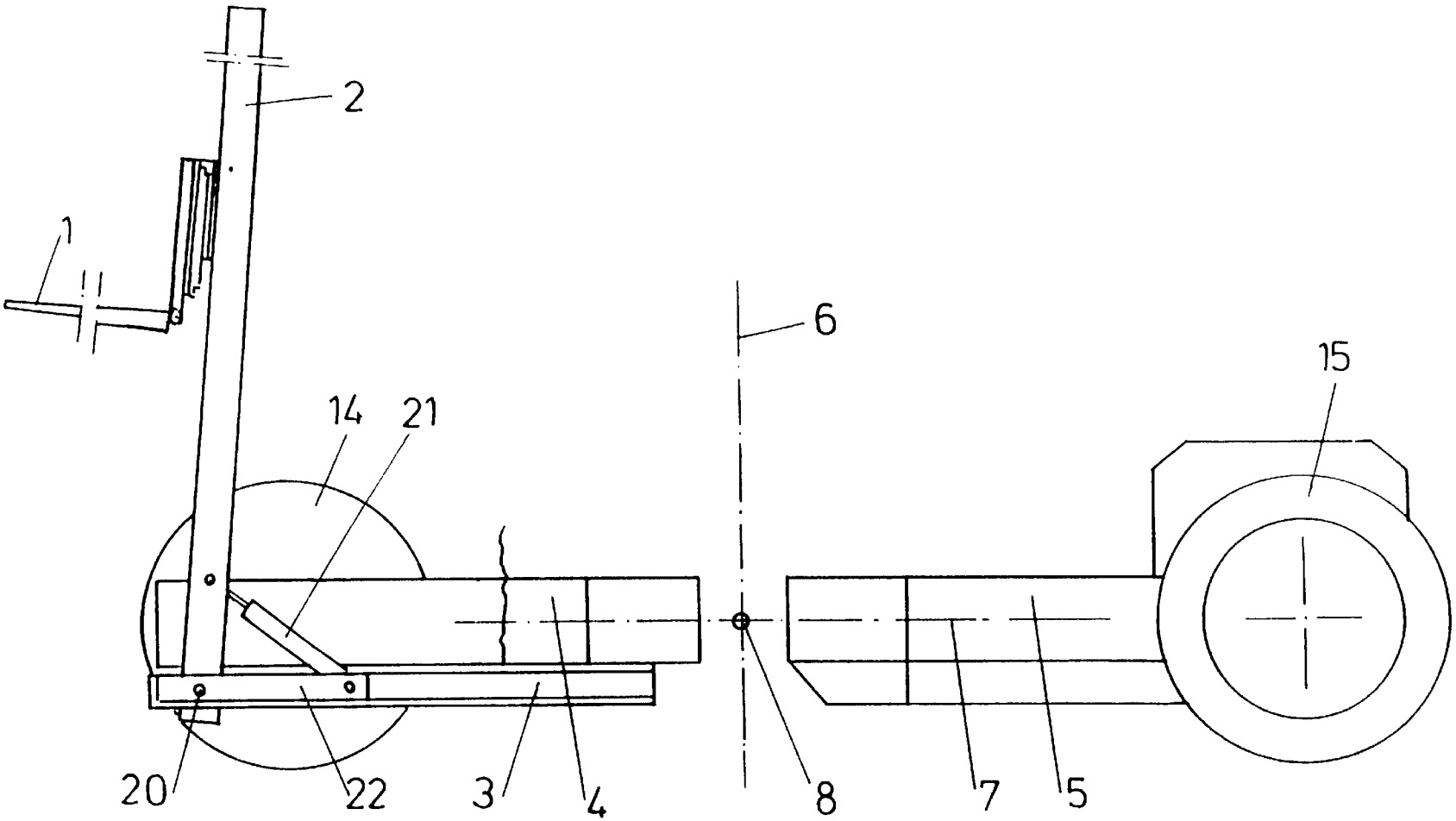

The invention concerns a forklift with four wheels mounted on a chassis and a gantry which carries the forks and can be folded into a transporting position.

It has been suggested on many occasions to provide forklifts with a foldable gantry, so that the forklifts could be transported underneath the loading surface of a truck. As for the underside of the container accommodating the forklift a certain clearance from the ground is necessary, only a very low space is available to accommodate the forklift during transport. To enable to introduce the equipment into this space, it has already been suggested (cf. EP 0 250 018 A1) to provide a special lifting and moving device.

The purpose of the invention is to provide a possibility to drive a foldable forklift into the storage space provided using its own drive. According to the invention this is made feasible by that the chassis consists of two parts, which can pivot relative to each other about a horizontal transverse axis and additionally about a vertical axis.

Irrespective as to where the forklift is stowed during its transport, the proposed measure has the advantage that the equipment can easily overcome gradations of all kinds.

A further advantage of the measure according to the invention is that the pivoting of the gantry carrying the lifting forks, which is necessary for the operation, can be carried out exclusively by actuating the hinge provided. The control of the folding, known per se, of this gantry into the transporting position can thus be made completely independent from the pivotings which are necessary for the operation caused by the incline of the ground or of the vehicle to be loaded.

Since in the sense of the invention the chassis comprises in any case two parts which can move relative to each other, it is advisable to make use of this flexibility for the steering of the vehicle also. Thus the steering is executed advantageously as a so called articulated frame steering, wherein the chassis parts can pivot relative to each other about a vertical axis. A particularly simple construction is achieved when the horizontal transverse axis and the vertical axis intersect and the joining of the chassis parts is executed as a universal joint. If in this case the gantry carrying the forks can be moved additionally longitudinally in a known manner, it will result in a considerable distance of the forks from the vertical pivoting axis. The lateral displacement of the gantry, often provided on forklifts, will become thus unnecessary, as almost the same effect can be achieved by the pivoting about the vertical axis taking place at great distance from the this axis.

The reciprocal rotation of the front and rear axle of the chassis about the longitudinal central axis of the vehicle (cf. U.S. Pat. No. 2,173,066) which is known in the case of vehicles separated in the longitudinal direction, is also useful in the case of a forklift according to the invention to compensate for the undulation of the ground. To prevent a lateral tipping of the gantry due to the weight of the rear part of the chassis, provision is made to limit the twisting about the horizontal longitudinal central axis by stops or it takes place against the effect of springs.

Figure 2:
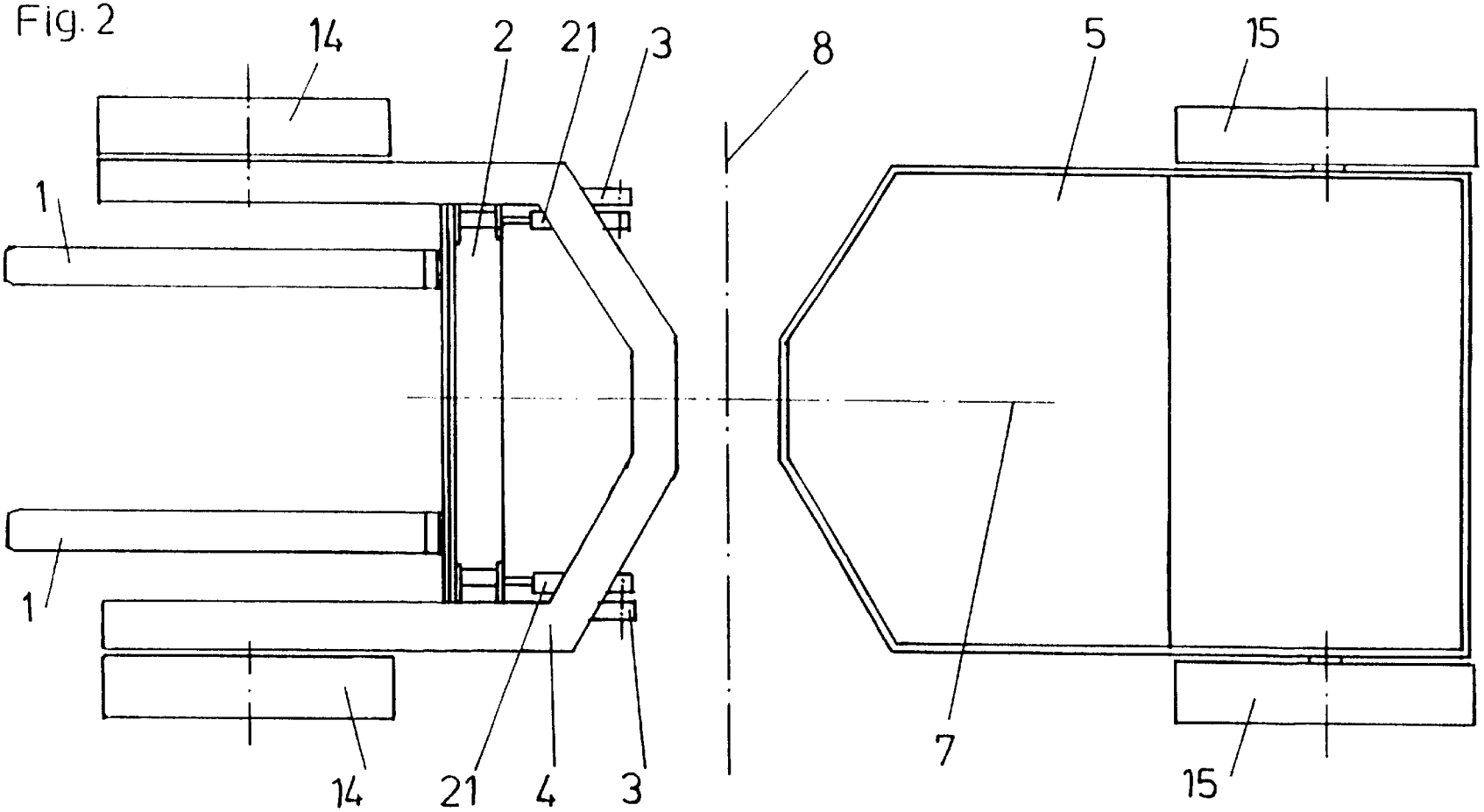
Figure 3:
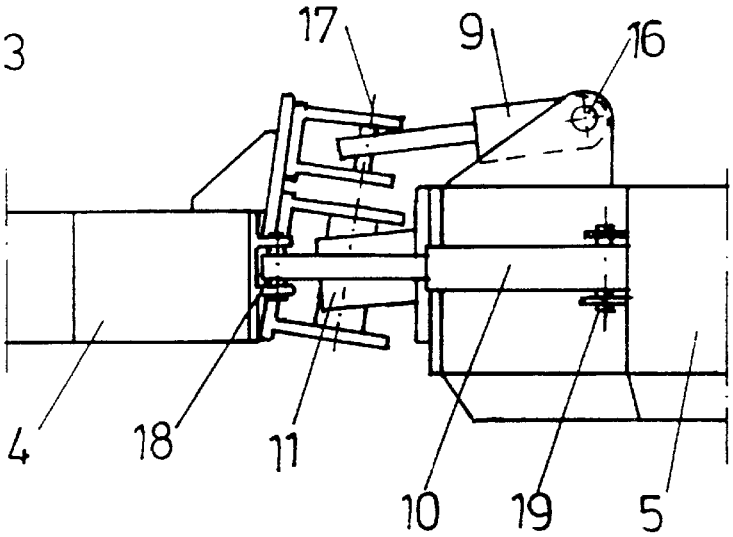
Figure 4:
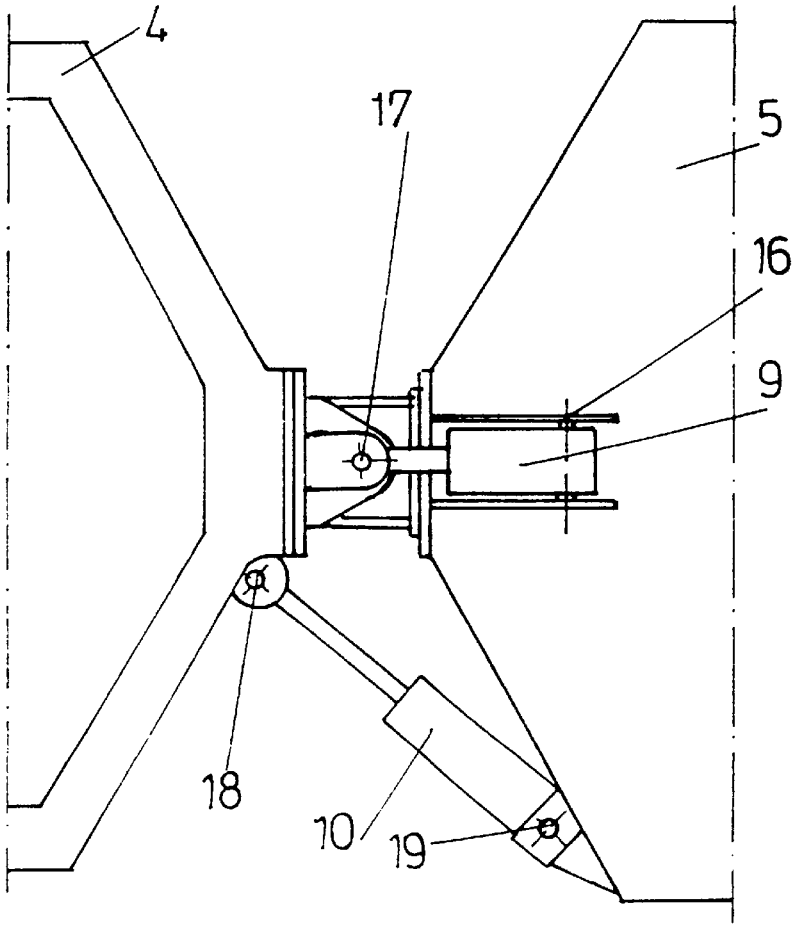

Details of the invention are explained in detail below based on the drawings. They show in:

FIG. 1—a schematic side view of a fork lift,

FIG. 2—the associated top view,

FIG. 3—an enlarged perspective illustration of the hinge region of the device according to FIGS. 1 and 2 in side view, and FIG. 4—the associated top view.

As it can be seen from FIGS.1 and 2, the fork lift according to the invention has a two-part chassis. The rear wheels 15 are mounted on the two sides of the rear chassis 5. Furthermore, the engine, the hydraulics as well as the control of the fork lift are accommodated on the rear chassis 5. To increase the stability of the fork lift additional weights may be provided on part 5.

The front chassis 4, on which the front wheels 14 are mounted, carries the gantry 2. (To make further details more visible, in FIG. 1 a front wheel 14 as well as the associated section of the chassis 4, carrying this front wheel, has been removed.) The forks 1 are arranged on the gantry 2 in a height-adjustable manner; the forks can be pivoted by 90°. On the one hand the gantry 2 itself can traverse along the guide rails 3 in the longitudinal direction of the fork lift and on the other laid flat for the purpose of transport by pivoting about the hinge point 20 by means of hydraulic piston/cylinder units 21 provided symmetrically on both sides. When the gantry 2 traverses in the longitudinal direction, the hydraulic piston/cylinder units 21 are moved with it on a common slide 22 (FIG. 1 shows the gantry 2 in the frontmost, FIG. 2 in the rearmost positions).

The possibilities of pivoting of both chassis 4 and 5 relative to each other is essential for this present invention, whereby in FIGS. 1 and 2 merely the centrelines of the connecting linkages are shown, which linkages are illustrated in detail in the subsequent figures. The horizontal transverse axis 8 makes an optimum matching to suit a drive-on ramp feasible, so that the fork lift according to the invention can be driven into a storage space provided on a truck by using its own drive. For the steering of the forklift a further vertical pivoting axis 6 is provided. Finally, to enable to equalise the undulations of the ground, the possibility of a passive torsional movement about a horizontal longitudinal axis 7 is provided.

The exact construction of the hinge 11 joining the chassis parts 4 and 5 can be understood on the basis of FIGS. 3 and 4. The hinge 11 is constructed as a universal joint, by means of which the horizontal transverse axis 8 and the vertical axis 6 are realised. For the control of the movements about both these axes a hydraulic piston/cylinder unit for each is provided. The ends of both of these hydraulic piston/cylinder units 9 and 10 engage one of the two chassis 4 and 5. The engagement points of the piston/cylinder unit 9 which is associated with the pivoting about the horizontal transverse axis 8 are designated by 16 and 17, those of the piston/cylinder unit 10 which is associated with the pivoting about the vertical axis are designated by 18 and 19. Due to the slightly inclined position of the vertical axis 6 seen in FIG. 3 an increase of the pivoting angle is achieved to compensate for convex undulations in the ground, the optimum compensation of which is particularly important when driving the forklift into the storage space of a truck. Both forks, which engage in the intersection of the universal joint 11, are connected rotatably with the respective chassis parts 4 and 5, enabling a rotation of these two parts 4 and 5 relative each other about a horizontal longitudinal axis.

I claim:

1. A forklift comprising a chassis having four wheels mounted thereon, and with a gantry mounted on said chassis and which carries forks and enables said forks to move in the vertical direction for lifting, and wherein the gantry can be folded down longitudinally into a transporting position, said chassis consisting of two parts joined together by a hinge and which pivot relative to each other about a horizontal transverse axis and additionally about a vertical axis, said hinge allowing for concurrent movement in the perpendicular axes.

2. A forklift according to claim 1, characterised in that the horizontal transverse axis and the vertical axis intersect and the joining of the chassis parts is executed as a universal joint.

3. A forklift according to claim 1, characterised in that the gantry carrying the forks is movable in the longitudinal direction of the forklift.

4. A forklift according to claim 1, characterised in that the two parts of the chassis can rotate relative to each other about a horizontal longitudinal axis.

5. A forklift according to claim 1, characterised in that two hydraulic piston/cylinder units are provided to control the movements of the chassis parts about the horizontal transverse axis and the vertical axis.

6. A forklift according to claim 5, characterised in that each hydraulic piston/cylinder unit has a first and a second end, each end engaging one of the two chassis parts.

* * * * *